US007938535B2

(12) United States Patent
Orlinsky et al.

(10) Patent No.: US 7,938,535 B2
(45) Date of Patent: May 10, 2011

(54) EYEWEAR AND CASE DISPLAY APPARATUS

(75) Inventors: Myron Orlinsky, Aventura, FL (US); Scott Orlinsky, Aventura, FL (US); Jason Orlinsky, Aventura, FL (US); Doris Uplinger, Pembroke Pines, FL (US)

(73) Assignee: Neoptx Ventures IP, LLC, Miramar, FL (US)

( * ) Notice: Subject to any disclaimer, the term of this patent is extended or adjusted under 35 U.S.C. 154(b) by 0 days.

(21) Appl. No.: 12/550,320

(22) Filed: Aug. 28, 2009

(65) Prior Publication Data

US 2010/0157239 A1 Jun. 24, 2010

Related U.S. Application Data

(60) Provisional application No. 61/093,253, filed on Aug. 29, 2008.

(51) Int. Cl.
*G02C 1/00* (2006.01)

(52) U.S. Cl. ..... 351/158; 211/85.1; 248/902

(58) Field of Classification Search ..... 351/41, 351/63, 158; 24/3.1, 3.7, 3.8; 206/5, 6; 211/85.1, 211/104; 248/309.1, 902
See application file for complete search history.

(56) References Cited

U.S. PATENT DOCUMENTS

| | | | | |
|---|---|---|---|---|
| 4,976,532 | A | 12/1990 | Nyman | |
| 5,129,617 | A | 7/1992 | MacWilliamson | |
| 6,772,878 | B1 | 8/2004 | Liebers | |
| 2009/0108161 | A1 * | 4/2009 | Liebers et al. | 248/309.1 |

FOREIGN PATENT DOCUMENTS

EP 1 031 061 B1 1/2002

* cited by examiner

*Primary Examiner* — Huy K Mai
(74) *Attorney, Agent, or Firm* — Christensen O'Connor Johnson Kindness PLLC

(57) ABSTRACT

An eyewear point-of-sale assembly for reading glasses, sunglasses or the like packaged with a carrying case such that a consumer may try on the eyewear without removing the eyewear from the packaging and without separating the carrying case from the eyewear. In one embodiment the packaging is formed from a planar template having a display panel that engages a conventional hanging-type display, a middle panel hingedly attached to the display panel, and defining a tab that engages an upper end of the case, and a lower panel that wraps around a bottom end of the case. The middle panel includes a lower portion that wraps around one temple portion of the eyewear. In another embodiment the packaging is formed from a planar template including a display panel, and a main panel that wraps about the case, and includes means for retaining one temple portion of the eyewear.

15 Claims, 8 Drawing Sheets

EYEWEAR AND CASE DISPLAY APPARATUS

CROSS-REFERENCE TO RELATED APPLICATION

This application claims the benefit of U.S. Provisional Patent Application No. 61/093,253, filed Aug. 29, 2008, the disclosure of which is hereby expressly incorporated by reference in its entirety.

BACKGROUND

Point of sale (POS) display packaging and devices, such as clamshell packaging and hang tags are known in the art. POS display devices for eyewear, such as reading glasses, present special requirements. Often purchasers desire to try on glasses before purchasing them, both to evaluate the aesthetic appearance of the eyewear, and in the case of reading glasses to test that they provide suitable magnification. In addition, it is desirable to avoid packaging that will leave a residue, such as adhesive or the like, on the eyewear. However, eyewear is relatively compact. If the eyewear is removed from its packaging customers may neglect to put it back with its packaging. Moreover, the glasses may be inadvertently, or deliberately, pocketed or otherwise concealed and removed from the store.

Moreover, reading glasses, sun glasses and the like are often sold as a package with a case for the glasses. The case is typically sized for a particular pair of glasses or a limited number of reading glasses designs. Therefore, it is desirable to keep the glasses and the case together as a package, while also allowing the customer to try on the glasses without removing the glasses from its display packaging.

POS hang tags for eyewear is known in the art. For example, U.S. Pat. No. 5,129,617 (MacWilliamson) discloses a "Hang Tag For Displaying Eyeglasses", which is hereby incorporated by reference in its entirety. MacWilliamson discloses an apparatus that includes a hang tag (10) having upper and lower temple slots (24, 26) that receive a temple piece (50) of the eyewear to attach it to the hang tag. A tongue portion (16) wraps around and through a slot (22) in the hang tag. An adhesive sealing tag (30) wraps around the temple piece of the eyewear, to secure it to the hang tag. This hang tag design has the disadvantage of requiring two-pieces for the packaging, placing the adhesive side of the tag directly on the eyewear temple piece, and does not include any means for also including a case for the glasses. A somewhat similar hang tag type of point of sale packaging is disclosed in U.S. Pat. No. 4,976,532 (Nyman), which is hereby incorporated by reference in its entirety.

A different packaging approach is disclosed in U.S. Pat. No. 6,772,878 (Liebers) titled "Package Containing Reading Glasses," which is hereby incorporated by reference in its entirety. Liebers et al. discloses a transparent plastic clamshell-type package that includes an upper cavity (32) that receives a case (36), and a lower cavity (34) that receives a pair of reading glasses (38). The temples (42) of the reading glasses extend out through openings (40), and the bottom of the container is contoured, such that the user can try on the reading glasses while they are in the package. The packaging has the disadvantage of being relatively complex (and therefore relatively expensive), and requiring potential purchasers to look through the packaging while trying on the glasses to test for suitable magnification etc.

Therefore, there remains a need for point of sale packaging for reading glasses and the like that is relatively simple, includes means for securing the reading glasses with a suitable case, and that allows the user to try on the reading glasses without removing the glasses from the packaging.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A point-of-sale assembly for eyewear is disclosed that includes eyewear such as reading glasses, sunglasses or the like, a case for the eyewear, and packaging that can be used with a conventional hanging-type point-of-sale display. The assembly allows the potential customer to try on the glasses to test for performance or aesthetics, without removing the glasses from the packaging and without separating the glasses from the case. The assembly also allows the glasses to be moved between the compact and more protected folded position, and the open position for testing.

In an embodiment the assembly includes a hanger-type packaging for retaining the pair of glasses and the carrying case together includes:

(i) an upper panel having an aperture for hanging the packaging on a point of sale display, and a tab portion inserted into the open upper end of the retained carrying case;

(ii) a middle panel hingedly connected to the upper panel and having an aperture that slidably receives the at least one temple of the retained glasses, the middle panel further comprising a lower portion that is wrapped around the temple received in the middle panel aperture;

(iii) a back panel extending from the upper panel and underlying the retained carrying case; and (iv) a lower panel extending from the back panel and having a distal end, the lower panel being folded around the lower end of the carrying case to overlie a portion of the carrying case; and means for securing the distal end of the lower panel to the back panel such that the carrying case is retained between the tab portion of the upper panel and the lower panel;

wherein the pair of glasses is retained by the middle panel such that the glasses are movable between an open position and a folded position without removing the glasses from the packaging.

In another embodiment the assembly includes a hanger-type packaging for retaining the pair of glasses and the carrying case together, that includes:

(i) an upper panel having an aperture for hanging the packaging on a point of sale display;

(ii) a main panel connected to the upper panel and having an upper aperture and a lower aperture that are sized and positioned to slidably receive the glasses temple, the main panel further comprising a lower portion defined by an elongate slit extending across most of the main panel width, and an adhesive edge that includes a free end of the lower portion;

wherein the main panel is sized and configured to extend entirely around the carrying case such that the adhesive edge engages an opposite edge of the main panel to secure the packaging to the carrying case after the temple is slidably received by the upper and lower apertures; and wherein the pair of glasses is retained by the main panel such that the glasses are movable between an open position and a folded position without removing the glasses from the packaging.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
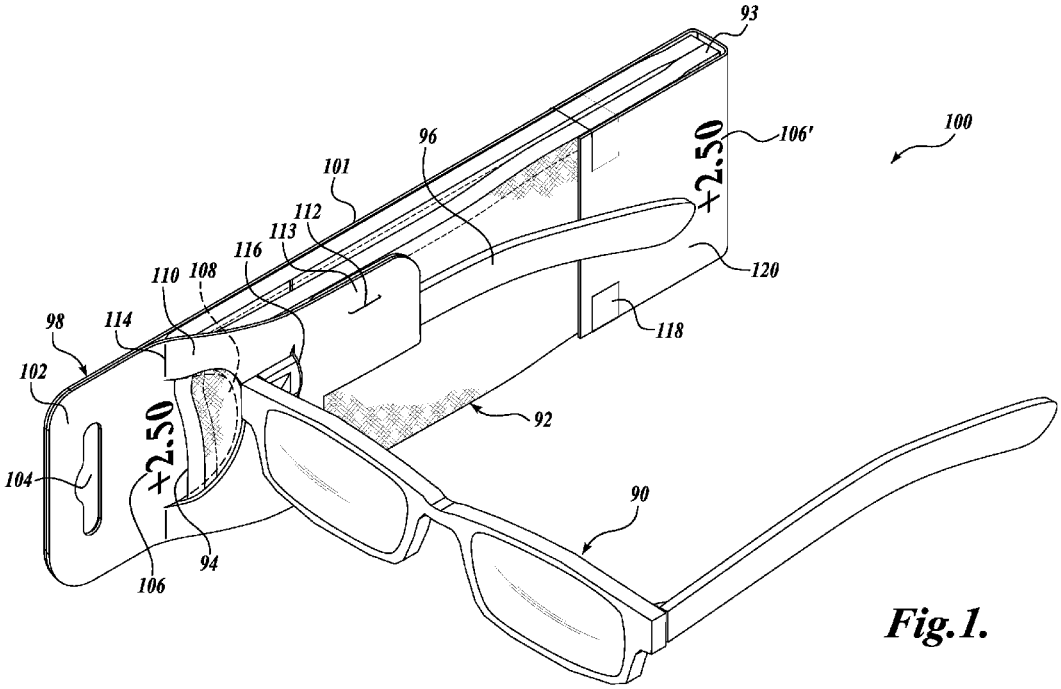
FIG. 1 is a perspective view of an eyewear and case point-of-sale assembly in accordance with the present invention.

FIG. 1 shows a perspective view of a currently preferred embodiment of a hanging-type point-of-sale assembly 100 including eyeglasses 90 such as reading glasses, sunglasses or the like, a carrying case 92 sized to receive the glasses 90, and point-of-sale packaging 98. The packaging 98 is attached directly to the carrying case 92 and the glasses 90, and is suitable for hanging on conventional display hangers, as are well-known in the art. The packaging 98 includes a back panel 101 that extends along the back side of the case 92, an upper panel 102, a middle panel 110 and a lower panel 120, as described below.

The packaging 98 upper panel 102 is disposed above the carrying case 92 and defines an elongate hanging slot 104. The upper panel 102 provides a display surface that may include indicia 106, to identify the product by trademark, provide descriptive information regarding the glasses 90 and/or case 92, provide pricing information, and otherwise attract interested buyers.

The middle panel 110 is hingedly connected to the upper panel 102 at hinge line 114. The middle panel 110 includes an aperture 116 that is sized to slidably receive one of the temples 96 of the glasses 90. A lower portion 113 of the middle panel 110 is sized and shaped to fold under the inserted temple 96, such that the lower portion 113 substantially encircles the temple 96. A central, downwardly-extending tab 108 (shown in phantom) is sized and positioned to extend into an open upper end 94 of the case 92.

The lower panel 120 folds under the bottom end 93 of the carrying case 92. It will be appreciated that the lower panel 120 also conveniently provides a display surface that may contain additional indicia 106' regarding the glasses 90 and case 92, for example. In this embodiment, a tape strip 118 extends around either side of the lower panel 120, at an end or intermediate location, attaching the lower panel 120 to the back panel 101. Although the tape strip 118 is currently preferred for ease of assembly, it is contemplated that the lower panel 120 may be attached to the back panel 101 by other means, for example one of the lower panel and back panel may be provided with tab portions that extending outwardly and are adapted to fold over and engage the other of the lower and back panel. In another embodiment a hoop, for example an elastic band, may be attached around the packaging and positioned to hold the lower panel in place.

FIG. 1 shows the glasses 90 in an open position, such that a prospective buyer may don the glasses 90, for example to assess the appearance or the performance of the glasses 90. This provides the prospective buyer a reasonable means for trying on the glasses 90 to test the feel, functionality and look of the glasses, without separating the glasses 90 from the accompanying carrying case 92, and without the glasses 90 being detached from the packaging 98. The glasses 90 may be moved between the folded and opened positions without removing them from the packaging 98.

It will also be appreciated that in this embodiment there is a large gap between the middle panel 110 and the lower panel 120, thereby exposing a significant portion of the carrying case 92, such that the pattern and texture of the carrying case 92 can be directly examined without removing the case 92 from the packaging 98. For example, in an embodiment the gap between the middle panel 110 and the lower panel 120 is between one and three inches.

It will also be appreciated that the glasses 90 are conveniently disposed directly over the carrying case 92, providing protection to the glasses 90 when in the folded position. Many carrying cases are fabricated from soft, pliable material, such as natural or artificial fabrics, leather, soft polymers or the like. Therefore packaging the glasses 90 directly over the carrying case 92 provides protection to the glasses 90. Moreover, the carrying case 92 is securely attached to the packaging 98 at both the upper end by the tab 108, and at the lower end by the lower panel 120 and tape strips 118.

Figure 2:
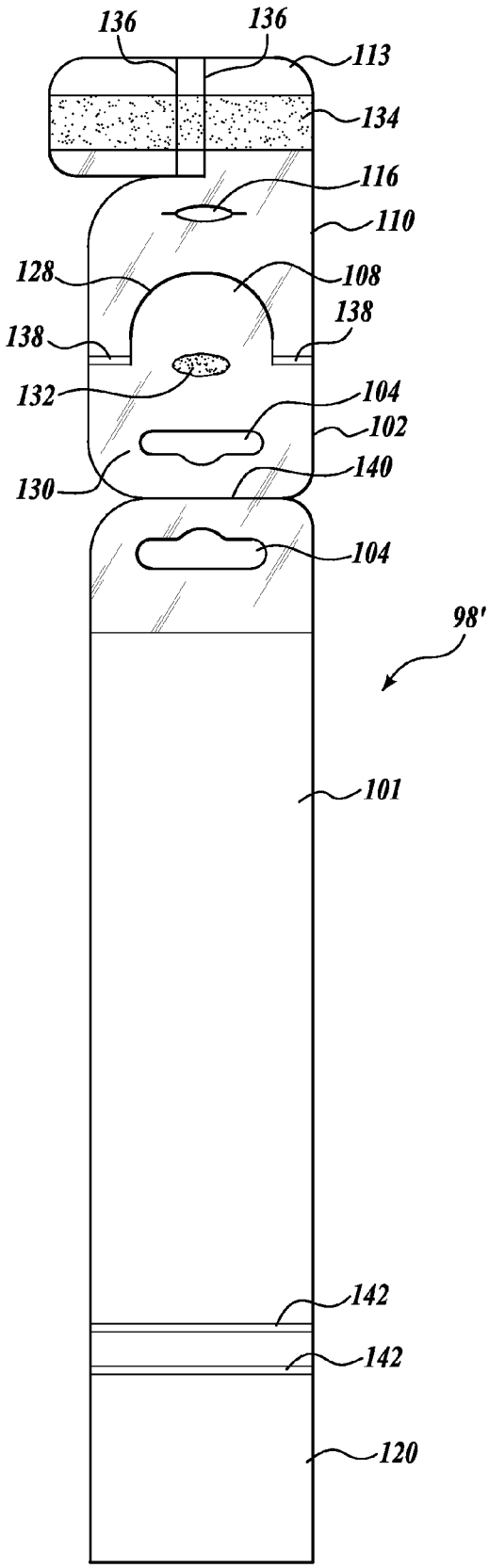
FIG. 2 shows a flat planar template of the packaging component of the eyewear point-of-sale assembly shown in FIG. 1.

Refer now to FIG. 2, which shows a planar pattern or template 98' that is precut, creased and ready for assembly with the glasses 90 and carrying case 92. In a current embodiment the pattern 98' is formed primarily from a paperboard product, although other materials such as polymeric sheets or the like may alternatively be used.

In this embodiment the template 98' is cut, e.g., die cut, to the desired shape, including cutting apertures for the hanging slot 104 and the temple aperture 116, and a slit 128 that defines the downwardly extending tab 108. The upper portion of the template 98' is provided with an optional polymeric surface layer 130 that is permanently adhered to the paperboard template 98', and provides a suitable base for an adhesive spot 132 and an adhesive strip 134, which are discussed below. First creases or fold lines 136 are formed on the lower portion 113 of the middle panel 110, to facilitate folding the lower portion 113 to encircle the glasses temple 96. Second creases or fold lines 138 are provided to define the hinge line 114 for the middle panel 110. A third crease or fold line 140 is provided midway between the apertures for the hanging slot 104, such that the upper portion of the template may be folded over, as described below. A fourth set of creases or fold lines 142 are provided near the bottom of the template 98' to facilitate folding the lower panel 120 over the front of the carrying case 92.

Figures 3A, 3B:
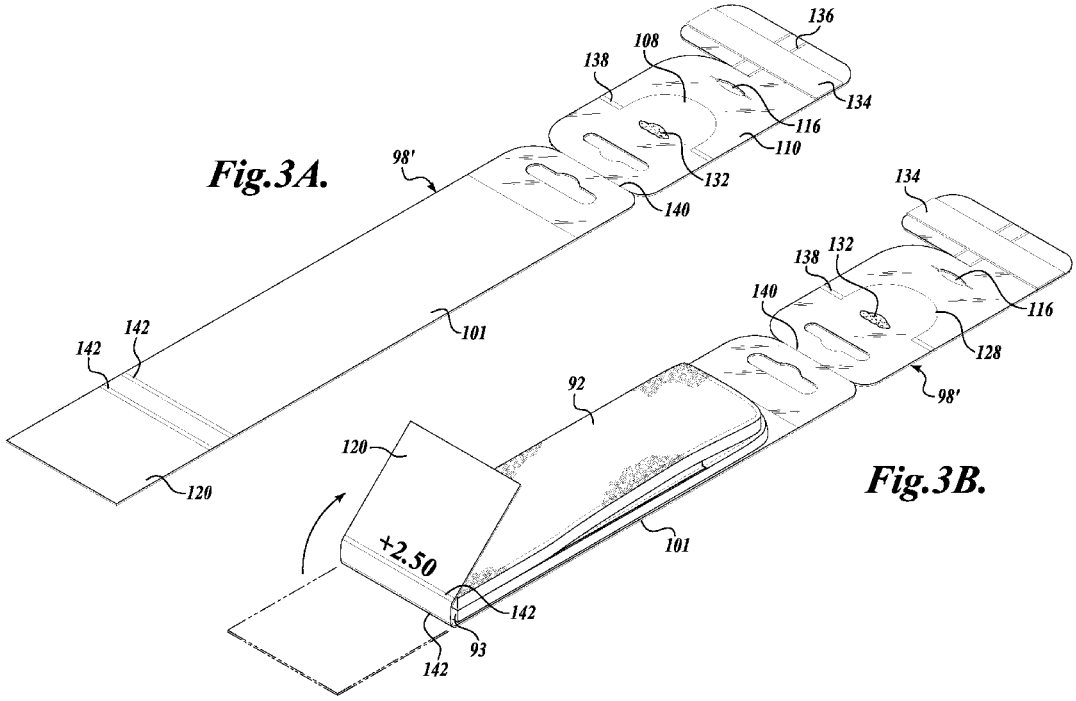
FIGS. 3A-3F illustrate assembly of the eyewear point-of-sale assembly shown in FIG. 1.
Figure 3C:
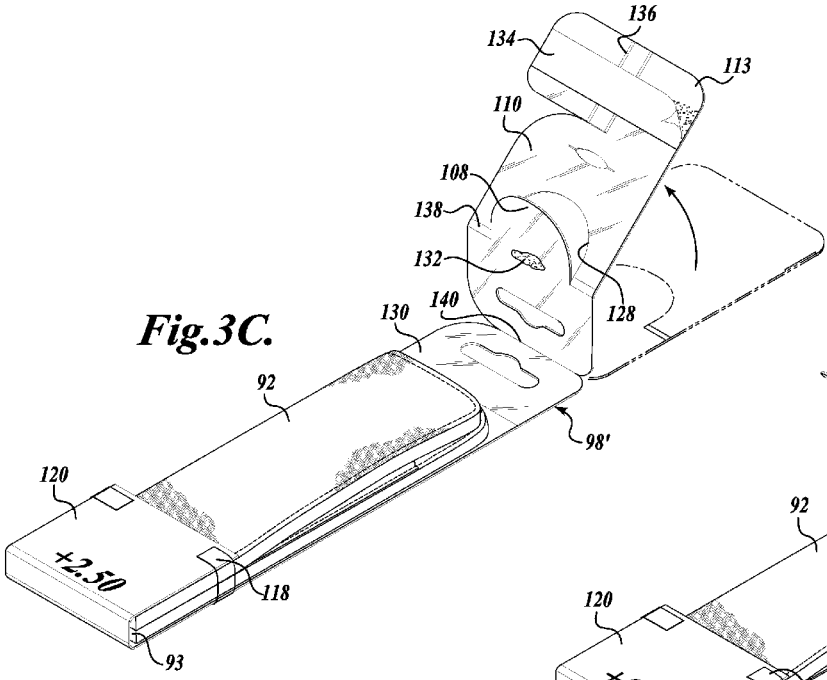

Assembly of the point-of-sale assembly 100 will now be described with reference to FIGS. 3A-3F. FIG. 3A shows a perspective view of the template 98' in position for assembly. In FIG. 3B the carrying case 92 is placed on the back panel 101 and the lower panel 120 is folded along the fourth fold lines 142 to overlie a front lower portion of the case 92. In FIG. 3C the upper portion of the template 98' is folded forwardly along the third fold line 140, while folding rearwardly along the second fold line 138 to separate the tab 108 along the defining arcuate slit 128. FIG. 3C also shows the placement of the tape strip 118 holding the lower panel 120 in position over the case 92.

Figure 3D:
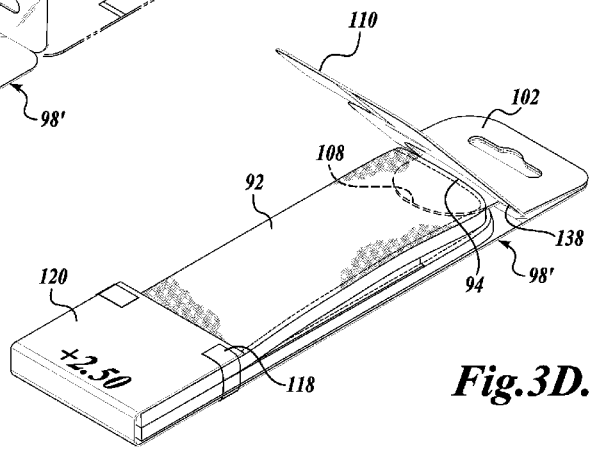
Figure 3E:
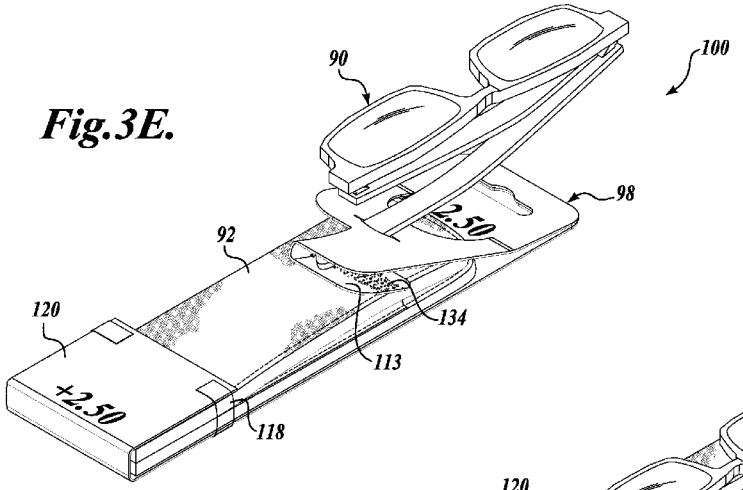
Figure 3F:
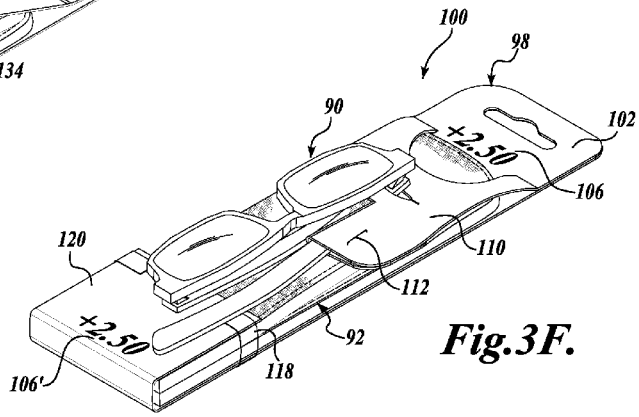

FIG. 3D shows the tab 108 inserted into the open upper end 94 of the case 92. In this step pressure is applied to the upper panel such that the adhesive spot 132 engages the lower end of the surface layer 130, holding front and back portions of the upper panel 102 together. In FIG. 3E one of the temples 96 of the glasses 90 is inserted through the aperture 116 in the middle panel 110, and the lower portion 113 is folded along the first fold lines 136 to encircle the temple 96, and the adhesive strip 134 adheres to the temple 96, and to opposite ends of the adhesive strip 134 engage to retain the glasses 90 on the packaging 98. As indicated in FIG. 3C, the adhesive strip 118 may conveniently comprise and adhesive covered with a peel away cover as are well-known in the art. The peel away cover has been removed in FIG. 3E. The completed point-of-sale assembly 100 is shown in FIG. 3F. Optionally, additional holding means, such as a staple 112 may be used to more securely hold the lower portion 113 in the folded position.

As will be clear by comparing FIG. 1 and FIG. 3F, the glasses 90 may now be compactly folded for shipping, transport and store display (FIG. 3F), and may be readily opened by a consumer to try on (FIG. 1), without removing the glasses 90 from the packaging 98, and without separating the glasses 90 from the associated carrying case 92. It will be appreciated that the packaging 98 and/or the carrying case 92 may include an antitheft device such as an RFID tag or the like, therefore providing some protection against inadvertent or deliberate removal of the glasses from the store without payment.

It will also be appreciated from FIG. 3F that in the disclosed assembly 100 that the upper panel 102, and in particular the indicia 106 thereon, is not blocked or obscured by the glasses 90 or the case 92. Similarly, the lower panel 120, and in particular the indicia 106' thereon, is also substantially visible even with the glasses 90 retained in the closed position, and the glasses 90 may be readily pivoted away from the lower panel 120 to easily view the indicia 106' thereon.

Figure 4:
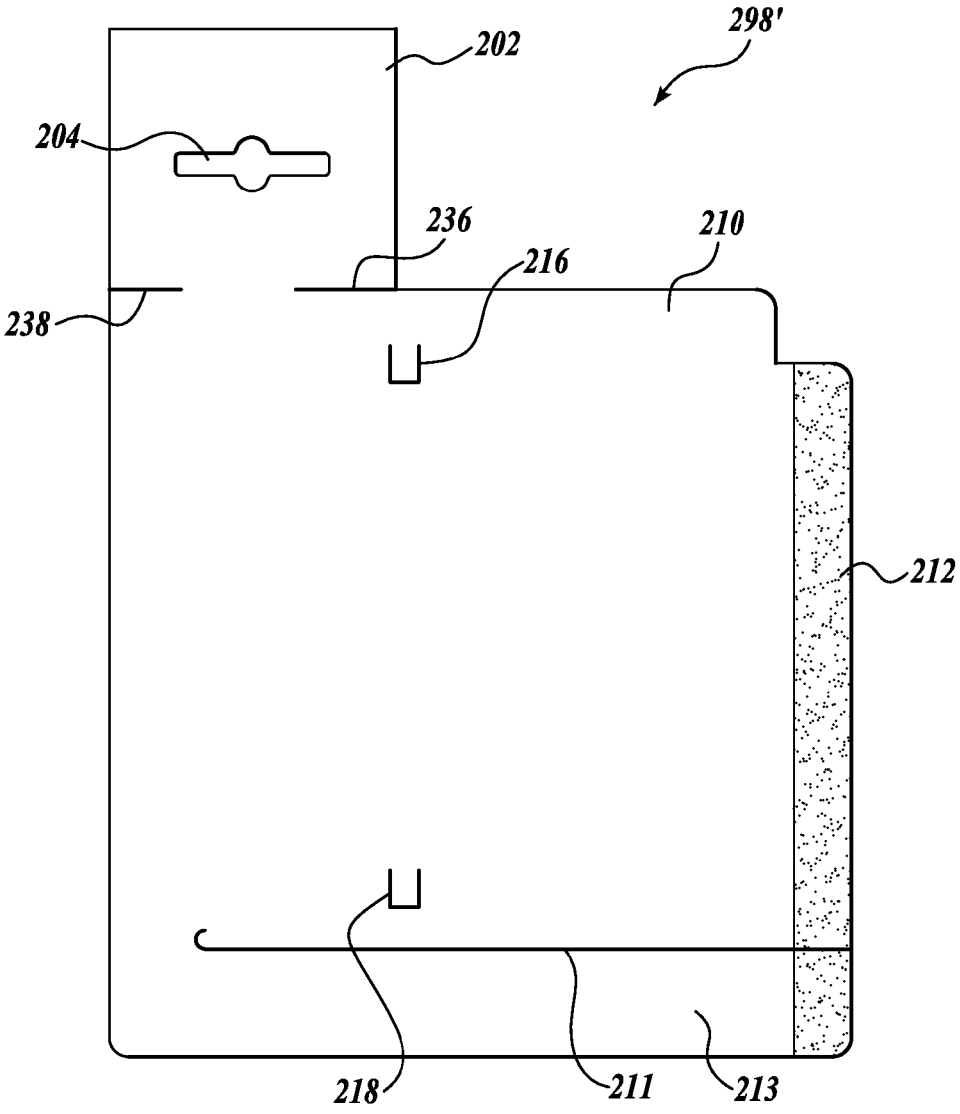
FIG. 4 shows a flat planar template of a packaging component for a second embodiment of an eyewear point-of-sale assembly in accordance with the present invention.
Figure 5A:
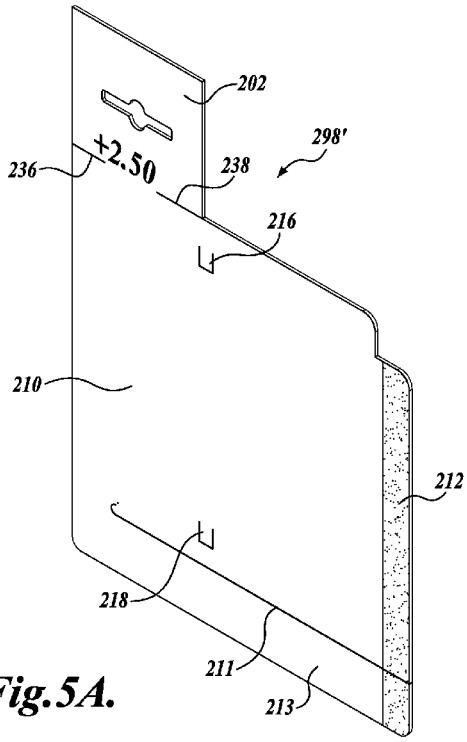
FIGS. 5A-5D illustrate assembly of the eyewear point-of-sale assembly using the packaging template shown in FIG. 4.
Figure 5B:
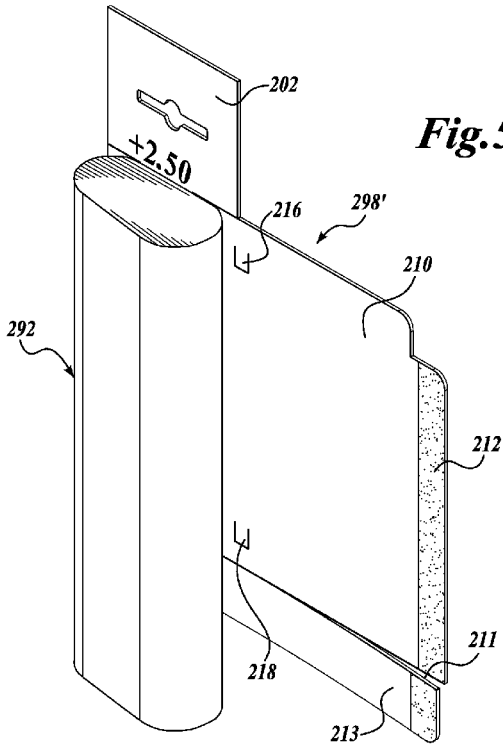
Figure 5C:
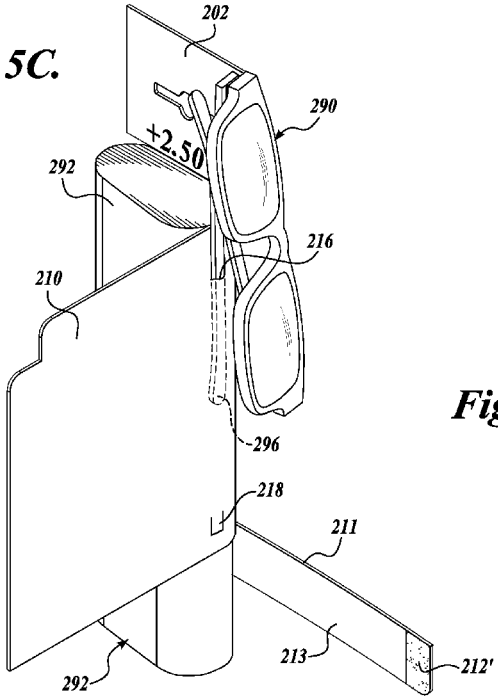
Figure 5D:
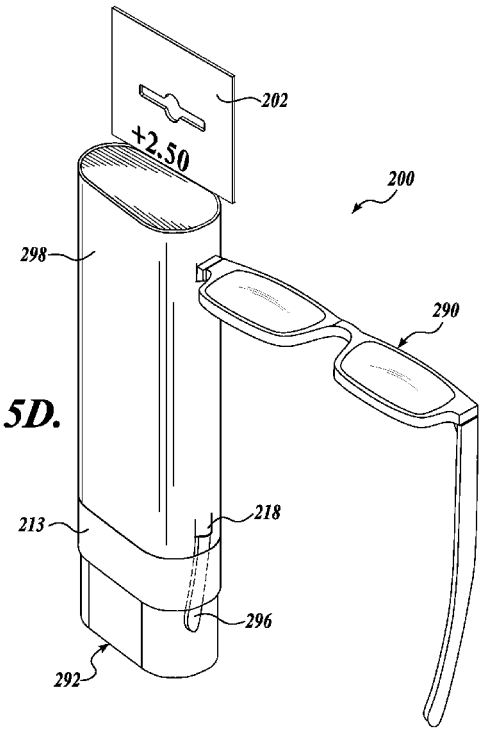

A second embodiment of a point-of-sale assembly 200 for eyewear in accordance with the present invention is shown in FIGS. 4-5D. This second embodiment is particularly suited to use for displaying glasses 290 that are sold with a more rigid carrying case 292, such as that shown in FIG. 5D.

Referring first to FIG. 5D, the point-of-sale assembly 200 includes glasses 290 such as reading glasses, sun glasses etc., a carrying case 292 and packaging 298. The glasses 290 are shown in the open position, wherein a consumer may try on the glasses 290 without removing them from the assembly 200 and without separating the glasses 290 from the carrying case 292.

Refer now to FIG. 4 which shows a planar pattern or template 298' for a packaging 298. In a current embodiment the template 298' is formed from a transparent polymeric panel and may include back-printed indicia thereon, for example to identify the product by trademark, provide descriptive information regarding the glasses 290 and/or case 292, provide pricing information, and otherwise attract interested buyers. However, it is contemplated that other materials may alternatively be used.

The template 298' includes an upper panel 202 defining an elongate hanging slot 204. The upper panel 202 provides a display surface that is disposed above the glasses 290 and case 292 when the assembly 200 is hung for point-of-sale display.

A main panel 210 is attached to the upper panel 202, and includes an upper slot 216 that is generally vertically aligned with a lower slot 218. A first edge portion includes an adhesive 212. A relatively long slit 211 extends from the first edge portion across most of the width of the main panel 210, defining a lower portion 213. In the current embodiment a pair of smaller slits 236, 238 partially separate portions of the upper panel 202 from the main panel 210.

The steps for assembling the point-of-sale eyewear assembly 200 is illustrated with FIGS. 5A-5D. FIG. 5A shows the template 298' precut, for example by die cutting, including the various slits 211, 216, 218, 236 and 238, and with an adhesive edge 212. The carrying case 292 may be positioned on the main panel 210 directly below the upper panel 202, as shown in FIG. 5B. One temple 296 of the glasses 290 is inserted through the upper slot 216, and moved down to pass through the lower slot 218. The upper portion of the main panel 210 may then be wrapped around the carrying case 292, and the adhesive edge 212 adhered to the opposite side of the main panel 210. The lower portion 213 of the main panel 210 is then wrapped around a lower portion of the temple 296 and the carrying case 292 such that the lower portion of the adhesive edge 212' is adhered to the opposite edge of the main panel 210. It will be appreciated that the packaging 298 is sized shorter than the carrying case 292, such that a portion of the carrying case 292 is not covered by the packaging 298, allowing consumers to appreciate the color and texture of the case 292.

This second embodiment eyewear point-of-sale assembly 200 shares many of the advantages discussed above with reference to the first embodiment. In particular, the glasses 290 may be worn by the consumer without removing them from the packaging 298, and without separating the glasses 290 from the carrying case 292. Typically, the upper panel 202 is not obstructed by the glasses 290 or the carrying case 292 when the assembly 200 is hung on a point-of-sale display. The packaging 298 may contain an antitheft device, for example an RFID tag or the like (not shown).

It will also be appreciated that the adhesive edge 212 adheres directly to other portions of the packaging 298, and in particular the adhesive does not directly contact either the glasses 290 or the carrying case 292. It will also be appreciated that the display apparatus may be easily fabricated from planar material, preferably a flexible plastic panel, and is very compact for efficient storage, shipping and the like.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A point of sale assembly for eyewear comprising:

a pair of glasses having at least one temple;

a carrying case having an open upper end sized to receive the pair of glasses and a lower end;

hanger-type packaging for retaining the pair of glasses and the carrying case together, the packaging comprising:

(i) an upper panel having an aperture for hanging the packaging on a point of sale display, and a tab portion inserted into the open upper end of the retained carrying case;

(ii) a middle panel hingedly connected to the upper panel and having an aperture that slidably receives the at least one temple of the retained glasses, the middle panel further comprising a lower portion that is wrapped around the temple received in the middle panel aperture;

(iii) a back panel extending from the upper panel and underlying the retained carrying case; and (iv) a lower panel extending from the back panel and having a distal end, the lower panel being folded around the lower end of the carrying case to overlie a portion of the carrying case; and means for securing the distal end of the lower panel to the back panel such that the carrying case is retained between the tab portion of the upper panel and the lower panel;

wherein the pair of glasses is retained by the middle panel such that the glasses are movable between an open position and a folded position without removing the glasses from the packaging.

2. The point of sale assembly of claim 1, wherein the means for securing the distal end of the lower panel comprises a strip of tape.

3. The point of sale assembly of claim 1, wherein the packaging comprises paperboard.

4. The point of sale assembly of claim 1, wherein the packaging is formed from a pre-cut paperboard template with a first fold line crease hingedly connecting the middle panel to the upper panel, and a second fold line crease connecting the lower panel to the back panel.

5. The point of sale assembly of claim 4, wherein at least of portion of the paperboard template has a polymeric surface layer affixed thereto.

6. The point of sale assembly of claim 4, wherein the paperboard template further comprises an adhesive strip on the lower portion of the middle panel.

7. The point of sale assembly of claim 4, wherein the tab portion is defined by an arcuate slit in the middle panel.

8. The point of sale assembly of claim 1, wherein there is a large gap between the lower panel and the middle panel such that a portion of the carrying case is exposed therebetween.

9. The point of sale assembly of claim 1, wherein the lower panel is spaced between one and three inches from the middle panel such that a portion of the carrying case is exposed therebetween.

10. The point of sale assembly of claim 1, wherein the glasses comprise reading glasses.

11. The point of sale assembly of claim 1, further comprising indicia printed on the upper panel and the lower panel.

12. The point of sale assembly of claim 1, wherein the carrying case comprises a soft and pliable material.

13. A point of sale assembly for eyewear comprising:

a pair of glasses having at least one temple;

a carrying case sized to receive the pair of glasses;

hanger-type packaging for retaining the pair of glasses and the carrying case together, the packaging comprising:

(i) an upper panel having an aperture for hanging the packaging on a point of sale display;

(ii) a main panel connected to the upper panel and having an upper aperture and a lower aperture that are sized and positioned to slidably receive the glasses temple, the main panel further comprising a lower portion defined by an elongate slit extending across most of the main panel width, and an adhesive edge that includes a free end of the lower portion;

wherein the main panel is sized and configured to extend entirely around the carrying case such that the adhesive edge engages an opposite edge of the main panel to secure the packaging to the carrying case after the temple is slidably received by the upper and lower apertures; and wherein the pair of glasses is retained by the main panel such that the glasses are movable between an open position and a folded position without removing the glasses from the packaging.

14. The point of sale assembly of claim 13, wherein the packaging comprises a polymeric panel.

15. The point of sale assembly of claim 13, wherein the main panel is sized much shorter than the carrying case such that a portion of the carrying case is exposed in the assembly.

* * * * *